US010221533B2

(12) United States Patent
Schaaf

(10) Patent No.: US 10,221,533 B2
(45) Date of Patent: Mar. 5, 2019

(54) SHORELINE STABILIZATION, RESTORATION, AND RUNOFF FILTRATION

(71) Applicant: SOX, LLC, Delray Beach, FL (US)

(72) Inventor: Daniel Shane Schaaf, Plymouth, MN (US)

(73) Assignee: SOX, LLC, Boca Raton, FL (US)

( * ) Notice: Subject to any disclaimer, the term of this patent is extended or adjusted under 35 U.S.C. 154(b) by 0 days.

(21) Appl. No.: 15/137,507

(22) Filed: Apr. 25, 2016

(65) Prior Publication Data

US 2016/0237635 A1 Aug. 18, 2016

Related U.S. Application Data

(63) Continuation of application No. 14/861,762, filed on Sep. 22, 2015.

(60) Provisional application No. 62/053,431, filed on Sep. 22, 2014, provisional application No. 62/141,576, filed on Apr. 1, 2015.

(51) Int. Cl.

| | |
|---|---|
| ***E02B 3/12*** | (2006.01) |
| ***E02D 17/20*** | (2006.01) |
| ***E02D 5/80*** | (2006.01) |
| ***A01G 2/00*** | (2018.01) |

(52) U.S. Cl.

CPC ..... *E02B 3/125* (2013.01); *A01G 2/00* (2018.02); *E02D 5/80* (2013.01)

(58) Field of Classification Search

CPC ... E02B 3/04; E02B 3/12; E02B 3/102; E02B 3/104; E02B 3/121; E02B 3/122; E02B 3/125; E02B 3/127; E02D 31/025; E02D 31/06; E02D 29/0208; E02D 29/0225;

(Continued)

(56) References Cited

U.S. PATENT DOCUMENTS 1,039,579 A 9/1912 Neames
3,786,640 A 1/1974 Turzillo (Continued)

FOREIGN PATENT DOCUMENTS

JP 09125336 A 5/1997

OTHER PUBLICATIONS

Shoresox LLC, Erosion Control—Official Journal of the International Erosion Control Association, May 2012, p. 51 (Year: 2012).*

(Continued)

*Primary Examiner* — Benjamin F Fiorello
*Assistant Examiner* — Stacy N Lawson
(74) *Attorney, Agent, or Firm* — Yong Chen

(57) ABSTRACT

A system for stabilization of a shoreline comprising a sheet having an unfolded state and a folded state, the sheet comprising a first edge and a second opposing edge connected by a first end and a second end, the sheet comprising a first layer formed from a first degradable fabric and a second layer formed from a second degradable fabric, the sheet further comprising channels formed at each of the first edge and the second edge, the channels formed from one or more of the first and the second fabrics, each of the channels comprising an anchor rope threaded therethrough, and each of the channels comprising a plurality of openings, wherein the anchor rope extends through the plurality of openings for securement to a shoreline surface by the anchor rope, and methods of using the same.

10 Claims, 3 Drawing Sheets

(58) Field of Classification Search
CPC ..... E02D 29/0233; E02D 29/0241; E02D 29/0291
USPC ..... 405/15–17, 19, 32, 111, 115, 302.6, 405/302.7
See application file for complete search history.

(56) References Cited

U.S. PATENT DOCUMENTS 3,788,253 A * 1/1974 Rickettson ..... E02D 17/12 112/402
4,690,585 A 9/1987 Holmberg
4,919,567 A 4/1990 Sample
4,960,349 A * 10/1990 Willibey ..... D03D 13/006 405/262
5,007,766 A 4/1991 Freed et al.
5,257,878 A 11/1993 Peterson
5,449,543 A * 9/1995 Bach ..... E02D 17/20 405/302.6
5,605,416 A * 2/1997 Roach ..... E02B 3/02 405/21
5,951,202 A 9/1999 Brown
6,343,193 B1 1/2002 Matsumoto et al.
6,346,193 B1 * 2/2002 Bauer ..... B01D 35/05 210/150
6,679,151 B1 1/2004 Rexroad
6,824,681 B2 * 11/2004 Engwer ..... E02B 3/125 210/170.03
6,893,193 B2 * 5/2005 Santha ..... E02B 3/12 405/15
6,913,423 B2 7/2005 Spangler et al.
7,029,208 B1 * 4/2006 Santha ..... E02B 3/125 405/15
7,431,533 B1 * 10/2008 Oda ..... E02B 3/104 405/107
7,811,028 B1 * 10/2010 de la Rosa ..... E02B 3/04 405/15
7,811,029 B2 10/2010 Graham et al.
8,070,387 B2 12/2011 Schaaf
8,246,274 B1 * 8/2012 Hall ..... E02D 17/20 405/262
2007/0003369 A1 * 1/2007 Hanson ..... E02B 3/04 405/19
2008/0131212 A1 * 6/2008 Quinley ..... E02B 8/02 405/302.6
2009/0133323 A1 * 5/2009 Farmer ..... A01G 17/04 47/9
2009/0208288 A1 8/2009 Stephens et al.
2009/0232599 A1 9/2009 Schaaf
2012/0207406 A1 * 8/2012 Cavenagh ..... E02B 3/108 383/38

OTHER PUBLICATIONS http://www.shoresox.com, screenshot of website dated Aug. 25, 2013 (Year: 2013).*
North American Green: Keeping Soil on the Golf Course—vol. 6 No. 1—Feb. 2000.
"Keeping Soil on the Golf Course," North American Green, 6(1):1-4, Feb. 2000.
"Overview: Another Future," Korea Petrochemical, 2 pages, Available Apr. 11, 2015.
"Sand Dune Stabalization and Beach Erosion Control," North American Green: Facts, Case Study, vol. 1, No. 1, 2 pages, Available Apr. 11, 2015.
"Specification Sheet—EroNet C125 Erosion Control Blanket," Tensar North American Green, 2 pages, 2013.

* cited by examiner

SHORELINE STABILIZATION, RESTORATION, AND RUNOFF FILTRATION

CROSS-REFERENCE TO RELATED APPLICATIONS

This application is a continuation of U.S. patent application Ser. No. 14/861,762, filed Sep. 22, 2015; which claims priority under 35 U.S.C. § 119 to U.S. Provisional Application Ser. No. 62/053,431, filed Sep. 22, 2014, and U.S. Provisional Application Ser. No. 62/141,576, filed Apr. 1, 2015, the entirety of which are incorporated herein by reference.

BACKGROUND OF THE INVENTION

The present invention relates generally to a method and system for creating and restoring eroded shorelines, and for further sustaining transplanted and indigenous plants and vegetation thereon, and for providing filtration for the affected body of water.

Shorelines surrounding many bodies of water have become unhealthy in recent years. The unhealthy nature of shorelines, such as shorelines surrounding ponds and lakes have suffered due to many reasons such as residential and commercial development, increased amounts of runoff dues to non-permeable surfaces, loss and removal of native shoreline vegetation, and many other reasons.

Unhealthy shorelines often result in deteriorating water conditions that are harmful to aquatic life. Absent healthy shorelines, silt, nitrates, phosphates, and other soluble and particulate matter are often able to flow unrestricted in bodies of water. These bodies of water may fill with silt and particulate matter, which may damage the ecosystem for aquatic life. Aquatic ecosystems may also be damaged, or otherwise altered form a healthy state, increasing algae growth and other invasive plants and aquatic life to flourish. The result is often an unhealthy body of water that not only disrupts or destroys naturally occurring aquatic ecosystems, but also disrupts recreation and other uses of these altered bodies of water.

Commonly owned U.S. Pat. No. 8,070,387 discloses one apparatus and method for shoreline stabilization, restoration and runoff filtration, the entire content of which is incorporated by reference herein.

There remains a need in the art for improved methods and systems for shoreline stabilization and management.

Without limiting the scope of the invention, a brief summary of some of the claimed embodiments of the invention is set forth below.

SUMMARY OF THE INVENTION

In one aspect, the present invention relates to a system for stabilization of a shoreline comprising a sheet having an unfolded state and a folded state, the sheet comprising a first edge and a second opposing edge connected by a first end and a second end, the sheet comprising a first layer formed from a first degradable fabric and a second layer formed from a second degradable fabric, the sheet further comprising channels formed at each of the first edge and the second edge, the channels formed from one or more of the first and the second fabric, each of the channels comprising an anchor rope threaded therethrough, each of the channels comprising a plurality of openings, the anchor rope extends through the plurality of openings for securement to a shoreline surface by the anchor rope.

In another aspect, the present invention relates to a method for stabilization of a shoreline comprising providing a sheet comprising a first edge and a second opposing edge connected by a first end and a second end, the sheet comprising a first layer formed from a first fabric comprising a degradable fabric and a second layer formed from a second fabric comprising a degradable fabric, the sheet further comprising channels formed at each of the first edge and the second edge, the channels formed from one or more of the first and the second fabric, each of the channels comprising an anchor roped threaded therethrough, placing the sheet on a selected shoreline in a flat state, providing an organic media on the sheet, folding the sheet in half over the organic media and securing the sheet with the drawstring to a plurality stakes set in said shoreline.

These and other aspects, embodiments and advantages of the present disclosure will become immediately apparent to those of Ordinary skill in the art upon review of the detailed Description and claims to follow.

DETAILED DESCRIPTION OF THE INVENTION

The present invention relates to a shoreline stabilization system to facilitate restoration of eroded shorelines and to promote growth of transplanted and/or native plants.

The shoreline system includes a sheet of fabric that may be filled with an organic media and then anchored along a shoreline of a body of water, such as an ocean inlet, lake, river, creek or pond, or any other body of water, to facilitate restoration of the shoreline. The system and method is described in detail below with respect to the figures.

While the system and methods disclosed herein are generally focused on shoreline restoration, the present invention also finds utility in erosion control including soil erosion, loss of wildlife habitat and so forth. Examples of more specific erosion control include, but are not limited to, control of hillside erosion, wind erosion, erosion caused by both wind and water in agriculture, land development, and so forth.

As used herein, "organic media" shall refer to organic matter that is compostable, biodegradable, sustainable and renewable, non-toxic and environmentally safe, that can support plant growth, and so forth.

Plant material is one source of suitable organic media.

Specific examples of suitable organic media include, but are not limited to, cornstalks, oat straw, wheat straw, grass clippings, compost, coconut and pine straw and pine saw, sawdust from any untreated wood, peat, mixtures thereof, and so forth.

This list is not intended as a limitation on the scope of the present invention. There are limitless types of organic media that may find use herein and providing a suitable organic media substitute is certainly within the purview of those of ordinary skill in the art.

Figure 1:
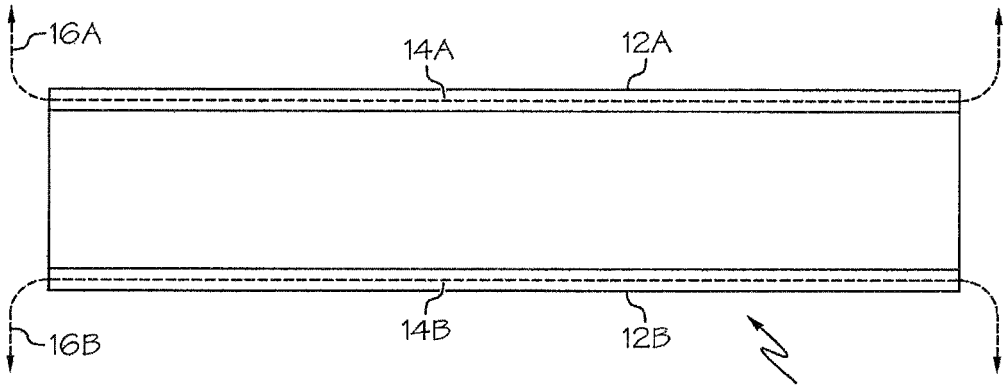
FIG. 1 is a flat view of a shoreline stabilization sheet having channels disposed at either edge for disposing an anchor rope therethrough.

Turning now to the figures, FIG. 1 is a flat view illustrating an embodiment of a shore stabilization system 10 according to the invention including a sheet 20. Sheet 20 comprises a first edge 12A and second opposing edge 12B. First edge 12A comprises a first channel 14A and second edge 12B comprises a second channel 14B. Each channel 14A, 14B further comprises an anchor rope 16A and 16B extending therethrough.

Suitably, each sheet 20 comprises a length of about 25 feet to about 200 feet (about 7.5 meters to about 60 meters). In some embodiments, sheet 20 is available in lengths of about 25 feet (about 7.5 meters), about 50 feet (about 15 meters), about 75 feet (about 25meters), about 100 feet (about 30 meters) and about 200 feet (about 60 meters).

Suitably, each sheet 20 is about 54 feet (about 1.25 meters) to about 10 feet (about 3 meters), and most suitably about 6 feet wide (about 1.75 meters).

Figure 2:
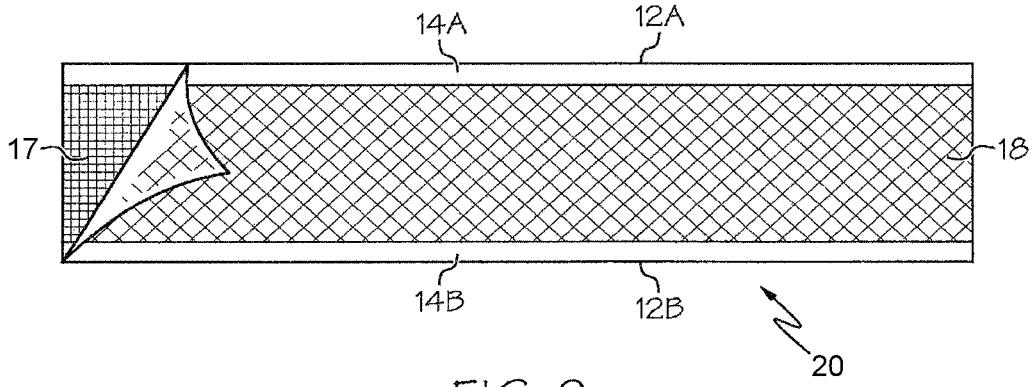
FIG. 2 is a flat view of one embodiment of the stabilization sheet according to the invention.

FIG. 2 is a flat view illustrating one embodiment of the shore stabilization system 10 wherein system 10 includes a sheet 20, the sheet 20 comprises a first layer 17 and a second layer 18. In this embodiment, layer 18 is shown in a mesh, woven or braided form, although other forms can also be employed herein.

Suitably, both layers 17, 18 of the sheet 20 are degradable. More suitably one layer degrades over a longer period of time than the other layer.

There are two types of degradable materials that may be employed herein including biodegradable materials and photodegradable materials.

Photodegradable materials are typically formed from oil-based polymers that have chemical bonds in the polymer structure that are weakened or broken by exposure to light or, the material may include a chemical additive which absorbs light and then attacks the polymer and breaks some of the bonds.

Biodegradable plastics can be made from oil or from plant-based products. They are attacked by bacteria, fungi or other micro-organisms which use them as food.

Of course, certain materials can be degradable simply by exposure to the elements.

In some embodiments, both layers may be biodegradable and in some embodiments, one layer is biodegradable and one layer is photodegradable.

Suitably layer 17 is biodegradable and layer 18 is photodegradable as will be explained in more detail below.

Examples of suitable biodegradable materials include, but are not limited to, burlap, flax, hemp, ramie, manila, sisal, cotton, kapok, alpaca, camel, cashmere, llama, mohair, vicuna, wool and silk.

Biodegradable polymers are well known in the art and include, but are not limited to, polylactic acid based polymers, polyglycolic acid based polymers, polyhydroalkanoate based polymers such as polyhydroxyvalerate and polyhydroxybutyrate, chitosan, cellulose, copolymers and terpolymers thereof, etc.

The above lists are intended for illustrative purposes only, and not as a limitation on the scope of the present invention.

Particularly suitable for use herein is burlap. Suitably, the burlap is an untreated burlap and in some embodiments, includes a jute fiber and/or other fibers.

One example of a commercially available burlap is an untreated 10 ounce burlap fabric including jute fiber.

Examples of suitable photodegradable materials include, but are not limited to, polyester, polyolefin and polycarbonate based materials.

The photodegradable fabric may be a knit, mesh, braided or woven polymer-based fabric. The photodegradable, woven polymer-based fabric may be selected based on the shade factor of the fabric, such as a shade factor of about 60%, 65%, 70%, 75%, 80%, etc. The shade factor percent may be selected based on factors that may affect growing conditions for the native and/or transplanted vegetation including airflow, water retention properties of the organic media employed, sunlight available to the shoreline system, abilities of grasses and other plants to spread into and grow through sheet, and other factors depending on the requirements of a particular installation.

In some embodiments, the photodegradable fabric is of a color, such as a light to medium tan color selected based on its solar absorption and reflectance properties. For example, when installed, a highly reflective color and/or surface, such as white, may cause too much sunlight to be reflected back onto the plants causing sunburn, wilting, and overheating. If the color of the second fabric is very dark such as black, the bag 300 and a media bale installed therein may become hot to a point to inhibit plant growth.

The photodegradable fabric is suitably selected so as to degrade over a period of years such as about 2-10 years, more suitably about 6 years or less, and most suitably about 4-5 years.

This allows sufficient time for vegetation such as the transplanted and/or native plants to provide a sufficient system to prevent further erosion of the shoreline and to provide a filtering system for the body of water for filtration of substances that may alter or otherwise be harmful to the health of the body of water.

In some specific embodiments, the present invention may be used for shoreline farming of edible aquatic or semi-aquatic plants.

One specific example would be for the shoreline farming of wild rice which is a semi-aquatic grass. Examples include, but are not limited to, Northern wild rice, Wild rice, Texas wild rice and Manchurian, the first three native to North America and the latter native to Asia. Some of these rice species are in danger of extinction. Thus, another benefit of employing the shoreline stabilization system disclosed herein for such purposes. The wild rice can be originally planted within the shoreline stabilization system for stabilization and rehabilitation of the shoreline. One this has occurred, the wild rice can be allowed to propagate and harvest.

Other example of an aquatic/semi-aquatic edible plant which can be employed herein is Watercress, a member of the cabbage family and native from Europe to central Asia and Water Spinach, a semi-aquatic tropical or sub-tropical plant native to East and Southeast Asia.

Another example of a very popular plant which can be employed herein is Wasabi, also a member of the cabbage family, the root of which is employed as a hot spice. This plant grows naturally along stream beds in mountain river valleys in Japan.

Yet further examples in include the water chestnut which is a grass-like sedge grown for edible corms which is cultivated in flooded paddy fields in China and the Philippines and the water caltrop which is a floating aquatic plant native to Eurasia and Africa Other examples of edible plants that can be employed herein include, but are not limited to, Taro or kalo which also is known for its edible corm, and Lotus, an aquatic plant.

Two other useful plants that can be employed herein include the Cattail, found largely in the Northern Hemisphere and in wetlands, a flowering plant which is beneficial to the health of wetlands and the bulrush, and its rhizome found in marshy areas from southern and western North America to South America and on Pacific islands, a plant that is highly beneficial to the health of ponds and marshes.

The photodegradable fabric may have a weight/square yard of about 2 ounces to about 10 ounces.

In some embodiments, the photodegradable, woven polymer-based fabric has a weight of about 4-5 ounces/square yard. In some embodiments, the photodegradable material is polypropylene having a weight of about 4.25 oz/sq.yard. In some embodiments, the photodegradable, woven polymer-based fabric is Yuhwa Polypro 1077 commercially available from Korea Petrochemical Inc. Co. Ltd. of Ulsan Korea.

The use of the shoreline stabilization system is explained in detail with respect to FIGS. 3-5 below.

Figure 3:
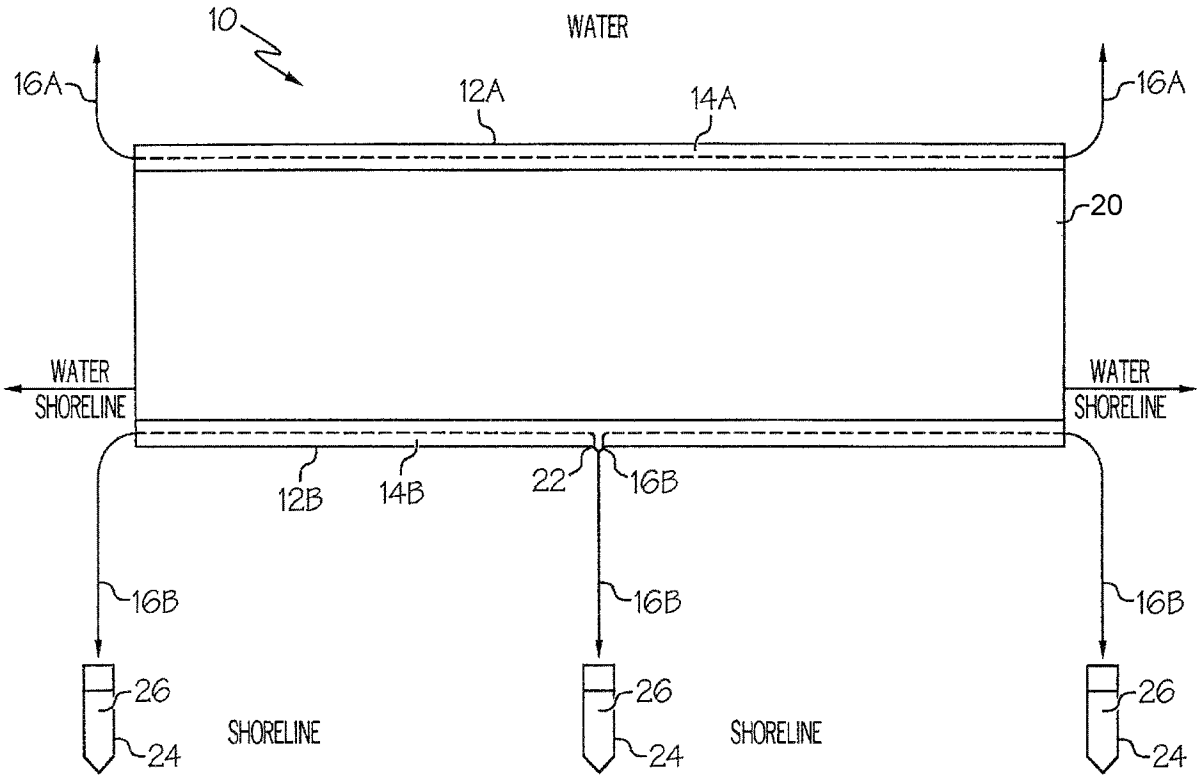
FIG. 3 is a flat view illustrating one embodiment of a shoreline stabilization system according to the invention.

FIG. 3 is a flat view of an embodiment of a shoreline stabilization system according to the invention. Sheet 10 includes edges 12A, 12B having channels 14A, 14B respectively. Disposed within each channel 14A, 14B respectively is an anchor rope 16A, 16B.

Anchor rope 16A, 16B can be formed from any suitable rope material. In some embodiments, anchor rope 16A, 16B is formed from polypropylene. In one embodiment, anchor rope 16A, 16B is formed from a one-eighth (⅛) inch diameter diamond braid, multifilament, polypropylene rope. However, other ropes of other materials may be used in other embodiments and this exemplary rope is not intended as a limitation on the scope of the present invention.

Sheet 10 can first be anchored to the shoreline at edge 12B as shown in FIG. 3. One end of anchor rope 16B and the other end of anchor rope 16*b* are each secured to the shoreline using any suitable method. In this embodiment, a stake 24 is employed as the securement means.

Stake 24 may be made from any suitable sustainable material such as wood or recycled plastics, such as from recycled water bottles or other recycled bottles, for example.

Anchor rope 16B is secured to stake 24 by any suitable means including threading through a hole 26 provided in stake 24.

In this embodiment, sheet 10 further includes an opening 22 in channel 14B and extending therethrough is shown a loop of anchor rope 16B. This allows the sheet to be secured by anchor rope 16B at a plurality of locations, suitably, each opening 22 is uniformly spaced along the length sheet 10.

Accordingly, edge 12A suitably includes a plurality of openings 22 in channel 14A with extend uniformly along the length of sheet 10 such that the openings 22 in channel 14A can be aligned with the openings 22 in channel 14B and anchor ropes 16A, 16B are likewise secured to the same stake at each opening 22.

Suitably, to conform to environmental regulations, such as those set by the Department of Natural Resources, each opening 22 is uniformly spaced along the length of sheet 10 about every 3 feet (about 1 meter) such that each edge 12A, 12B can be secured stakes 24 in the shoreline which are also uniformly spaced about 3 feet apart (about 1 meter) at the shoreline stabilization and restoration site.

Figure 4:
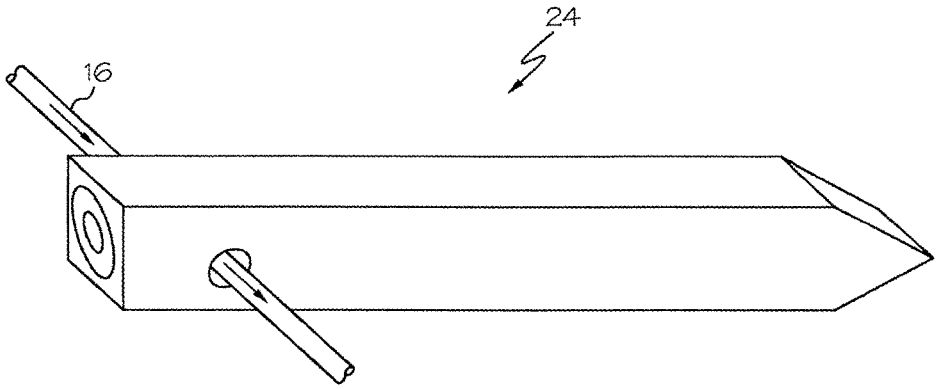
FIG. 4 is a side perspective view of one embodiment of a securement stake for securing a shoreline stabilization sheet to the shoreline.

FIG. 4 is an enlarged view of one embodiment of a stake 24 which may be employed to secure the shore stabilization sheet 20 to the shoreline. Anchor rope 16 is shown threaded through stake 24.

Suitably, each stake 24 is pounded below grade in the shoreline such that it is not exposed to the population or to wildlife.

Figure 5:
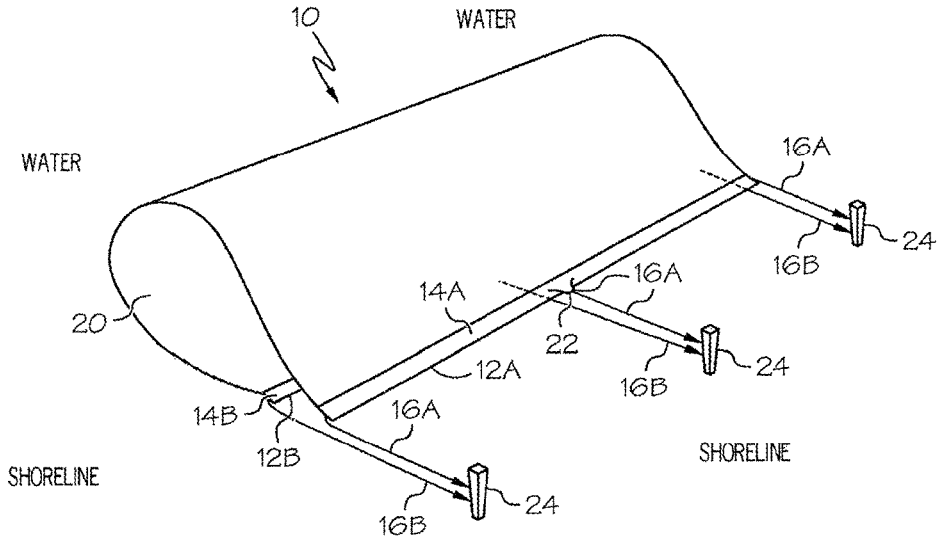
FIG. 5 is a perspective view illustrating how the shoreline stabilization system during installation on a shoreline.

FIG. 5 is a perspective view illustrating how the shoreline stabilization system 10 may be installed on a shoreline. As shown in FIG. 4, an edge 12B of sheet 20 is first secured to a shoreline via stakes 24. An organic media (not shown) may be placed on sheet 20 while in its flat state. An edge 12A of sheet 20 is then brought over the top of the edge 12B and secured to the stakes 24 as shown, thus trapping the organic media within the shoreline stabilization sheet 20.

During use, the sheet may be cut at desired locations allowing insertion of plants and nutrient enriched soil into the organic media. The shoreline stabilization sheet 10 maintains the plants during growth and stabilization via the spread of transplanted and native plants to provide a healthy root system.

The present invention allows for the use of any organic media that is locally available. The use of locally available media drastically reduces shipping costs.

There are many advantages to employing a shoreline stabilization system in the form of a flat sheet rather than as an already prepared module containing organic media, including, but not limited to, a reduction in shipping costs, use of locally provided organic media, stakes are only placed in the bank of the shoreline and not in the water bed, seams are eliminated, does not require threading through of anchor ropes, and so forth.

A further significant advantage of the present invention is that the amount of organic media employed within the edges of the shoreline stabilization sheet may be adjusted to accommodate grades from about 1 inch (about 2.5 cm) to about 68 inches (about 175 cm) per a 6 foot wide (about 1.75 meters) flat sheet. The shorter the bank, the more organic media that may be required.

Such embodiments as described and illustrated herein provide a durable, yet degradable shoreline restoration system constructed by layering a natural absorbent material, the organic media within a durable, porous yet degradable shoreline stabilization sheet. The selection of each material may vary without departing from the inventive nature of the subject matter herein. Further, embodiments herein provide anchoring systems and methods that sustain wear over a period, such as about 4-6 years, that allows vegetation to grow to re-anchor the restored shoreline with the root system of the plants and vegetation.

The present invention has the further added benefit of providing a filtration system wherein undesirable substances that may negatively impact the health of the ecosystem are filtered out prior to entering the water system. For example, excessive nutrients from fertilizer runoff such as phosphates and nitrates are filtered out in amounts of up to about 75% nitrates and up to about 60% phosphates.

The description provided herein is not to be limited in scope by the specific embodiments described which are intended as single illustrations of individual aspects of certain embodiments. The methods, compositions and devices described herein can comprise any feature described herein either alone or in combination with any other feature(s) described herein. Indeed, various modifications, in addition to those shown and described herein, will become apparent to those skilled in the art from the foregoing description and accompanying drawings using no more than routine experimentation. Such modifications and equivalents are intended to fall within the scope of the appended claims.

All published documents, including all US patent documents and US patent publications, mentioned anywhere in this application are hereby expressly incorporated herein by reference in their entirety. Any copending patent applications, mentioned anywhere in this application are also hereby expressly incorporated herein by reference in their entirety. Citation or discussion of a reference herein shall not be construed as an admission that such is prior art.

I claim:

1. A method for installing an erosion control system comprising a sheet having a first edge and a second edge, and a body region positioned between the first edge and the second edge, the first edge having a first length, wherein the first edge comprises a first channel in which a first anchoring rope is threaded, the first channel comprising two first outer side openings through which the first anchoring rope extends out of the first channel, and at least one first intervening opening through which at least one segment of the first anchoring rope is exposed, and wherein the second edge comprises a second channel in which a second anchoring rope is threaded, the second channel comprising two second outer side openings through which the second anchoring rope extends out of the second channel, and at least one second intervening opening through which at least one segment of the second anchoring rope is exposed, the method comprising, in the following sequence:

placing a plurality of stakes along a bank of a shoreline, the plurality of the stakes comprising two outer stakes and at least one intervening stake;

securing the first edge of the sheet to the plurality of stakes by securing two ends of the first anchoring rope to the two outer stakes, and coupling the at least one exposed segment of the first anchoring rope to the at least one intervening stake;

arranging the sheet so that at least a portion of the sheet is lying flat on the ground and forms an organic material holding region extending from the first edge;

disposing an organic material on top of the organic material holding region such that the organic material is disposed on top of the first edge;

bringing the second edge of the sheet over the first edge, thereby trapping the disposed organic material by the sheet; and securing the second edge of the sheet to the plurality of stakes by securing two ends of the second anchoring rope to the two outer stakes, and coupling the at least one exposed segment of the second anchoring rope to the at least one intervening stake;

wherein at the completion of the installation, along at least a portion of the first length, the first edge is free from attachment to the second edge, and the second edge is disposed between the first edge and the plurality of stakes.

2. The method of claim 1 wherein the bank of the shoreline is defined by a grade, and wherein the step of placing the plurality of the stakes comprises placing the plurality of stakes below the grade of the shoreline.

3. The method of claim 1 wherein the plurality of stakes each comprise apertures therethrough and the first edge of the sheet and the second edge of the sheet are secured to the apertures.

4. The method of claim 1 wherein the bank of the shoreline comprises a grade from about 1 inch to about 68 inches.

5. The method of claim 1 further comprising cutting slits in an upper surface of the sheet, and disposing native plants in the slits of the upper surface.

6. The method of claim 5, wherein the native plants comprise an edible plant selected from the group consisting of wild rice, watercress, wasabi, water chestnut, taro, lotus, and cattail.

7. The method of claim 1 wherein the sheet comprises burlap.

8. The method of claim 1 wherein the sheet comprises a photodegradable material, a biodegradable material or a combination thereof.

9. The method of claim 1 wherein the plurality of stakes are uniformly spaced.

10. The method of claim 9 wherein the plurality of stakes are uniformly spaced about three feet apart.

* * * * *